US007239298B2

(12) United States Patent
Adachi et al.

(10) Patent No.: US 7,239,298 B2
(45) Date of Patent: Jul. 3, 2007

(54) LIQUID CRYSTAL DISPLAY APPARATUS

(75) Inventors: Takako Adachi, Mie (JP); Makoto Shiomi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 549 days.

(21) Appl. No.: 10/738,596

(22) Filed: Dec. 18, 2003

(65) Prior Publication Data

US 2004/0125064 A1 Jul. 1, 2004

(30) Foreign Application Priority Data

Dec. 19, 2002 (JP) ..... 2002-368353
May 23, 2003 (JP) ..... 2003-146623

(51) Int. Cl.
*G09G 3/36* (2006.01)

(52) U.S. Cl. ..... 345/89; 345/690

(58) Field of Classification Search ..... 34/87–89, 34/98–100, 690, 211
See application file for complete search history.

(56) References Cited

U.S. PATENT DOCUMENTS 5,528,257 A * 6/1996 Okumura et al. ..... 345/99
6,825,824 B2 * 11/2004 Lee ..... 345/89
7,084,846 B2 * 8/2006 Adachi et al. ..... 345/89
2003/0098839 A1 * 5/2003 Lee ..... 345/89

FOREIGN PATENT DOCUMENTS

| | | |
|---|---|---|
| JP | 64-010299 | 1/1989 |
| JP | 03174186 | 7/1991 |
| KR | 2001-0055986 | 7/2001 |

OTHER PUBLICATIONS

Korean Office Action dated Nov. 21, 2005.

* cited by examiner

*Primary Examiner*—Regina Liang
(74) *Attorney, Agent, or Firm*—Harness, Dickey & Pierce, P.L.C.

(57) ABSTRACT

The liquid crystal display apparatus of the present invention includes: a liquid crystal panel having a liquid crystal layer and an electrode for applying a voltage to the liquid crystal layer; and a drive circuit for supplying a drive voltage to the liquid crystal panel. The drive circuit supplies a drive voltage obtained by giving an overshoot to a gray-scale voltage corresponding to an input image signal in the current vertical period, the drive voltage being determined in advance according to a combination of an input image signal in the immediately-preceding vertical period processed based on a predicted value of the transmittance of the liquid crystal panel in the immediately-preceding vertical period and the input image signal in the current vertical period.

6 Claims, 10 Drawing Sheets

FIG. 6

18

| Predicted signal | Input image signal | | | | | | | | |
|---|---|---|---|---|---|---|---|---|---|
| | 0 | 32 | 64 | 96 | 128 | 160 | 192 | 224 | 255 |
| 0 | 0 | 128 | 204 | 221 | 231 | 241 | 249 | 255 | 255 |
| 32 | 0 | 32 | 151 | 197 | 211 | 225 | 241 | 248 | 255 |
| 64 | 0 | 0 | 64 | 145 | 176 | 210 | 224 | 244 | 255 |
| 96 | 0 | 0 | 24 | 96 | 147 | 194 | 220 | 243 | 255 |
| 128 | 0 | 0 | 5 | 62 | 128 | 183 | 209 | 241 | 255 |
| 160 | 0 | 0 | 2 | 24 | 84 | 160 | 199 | 234 | 255 |
| 192 | 0 | 0 | 0 | 11 | 46 | 141 | 192 | 229 | 255 |
| 224 | 0 | 0 | 0 | 0 | 20 | 96 | 172 | 224 | 255 |
| 255 | 0 | 0 | 0 | 0 | 0 | 45 | 141 | 218 | 255 |

FIG. 7

19

| Predicted signal | Input image signal | | | | | | | | |
|---|---|---|---|---|---|---|---|---|---|
| | 0 | 32 | 64 | 96 | 128 | 160 | 192 | 224 | 255 |
| 0 | 0 | 29 | 61 | 91 | 120 | 153 | 177 | 193 | 194 |
| 32 | 23 | 32 | 63 | 92 | 123 | 155 | 181 | 220 | 238 |
| 64 | 34 | 39 | 64 | 95 | 124 | 156 | 186 | 222 | 247 |
| 96 | 52 | 54 | 66 | 96 | 125 | 157 | 187 | 223 | 249 |
| 128 | 64 | 65 | 70 | 97 | 128 | 159 | 188 | 223 | 252 |
| 160 | 73 | 77 | 78 | 98 | 130 | 160 | 189 | 224 | 253 |
| 192 | 89 | 92 | 94 | 99 | 127 | 161 | 192 | 224 | 254 |
| 224 | 112 | 113 | 108 | 110 | 131 | 162 | 193 | 224 | 254 |
| 255 | 133 | 133 | 134 | 134 | 138 | 163 | 190 | 225 | 255 |

FIG. 8

18a

| | | Input image signal | | |
|---|---|---|---|---|
| | | 0 | 128 | 255 |
| Predicted signal | 0 | A | B | C |
| | 128 | D | E | F |
| | 255 | G | H | I |

FIG. 9

18a

| | | Input image signal | | |
|---|---|---|---|---|
| | | 0 | 128 | 255 |
| Predicted signal | 0 | 0 | 168 | 255 |
| | 128 | 0 | 128 | 255 |
| | 255 | 0 | 90 | 255 |

FIG. 10

18b

| | | Input image signal | | | | | | | | |
|---|---|---|---|---|---|---|---|---|---|---|
| | | 0 | 32 | 64 | 95 | 128 | 160 | 192 | 224 | 255 |
| Predicted signal | 0 | 0 | 42 | 84 | 126 | 168 | 130 | 212 | 233 | 255 |
| | 32 | 0 | 32 | 74 | 116 | 158 | 190 | 212 | 233 | 254 |
| | 64 | 0 | 32 | 64 | 106 | 148 | 180 | 212 | 233 | 254 |
| | 95 | 0 | 32 | 64 | 96 | 138 | 170 | 202 | 233 | 254 |
| | 128 | 0 | 32 | 64 | 96 | 128 | 160 | 192 | 223 | 255 |
| | 160 | 0 | 23 | 55 | 87 | 119 | 160 | 192 | 223 | 254 |
| | 192 | 0 | 23 | 45 | 77 | 109 | 150 | 192 | 223 | 254 |
| | 224 | 0 | 23 | 45 | 63 | 100 | 141 | 182 | 224 | 254 |
| | 255 | 0 | 23 | 45 | 63 | 90 | 132 | 173 | 214 | 255 |

FIG. 11

18

| | | Input image signal | | | | | | | | |
|---|---|---|---|---|---|---|---|---|---|---|
| | | 0 | 32 | 64 | 96 | 128 | 160 | 192 | 224 | 255 |
| Predicted signal | 0 | 0 | 45 | 118 | 147 | 168 | 186 | 208 | 241 | 255 |
| | 32 | 0 | 32 | 90 | 123 | 145 | 180 | 205 | 239 | 255 |
| | 64 | 0 | 24 | 64 | 105 | 139 | 176 | 203 | 234 | 255 |
| | 96 | 0 | 15 | 54 | 96 | 131 | 172 | 202 | 232 | 255 |
| | 128 | 0 | 10 | 42 | 87 | 128 | 166 | 197 | 230 | 255 |
| | 160 | 0 | 8 | 39 | 81 | 119 | 160 | 196 | 227 | 255 |
| | 192 | 0 | 6 | 35 | 74 | 109 | 154 | 192 | 225 | 255 |
| | 224 | 0 | 3 | 29 | 63 | 98 | 148 | 184 | 224 | 255 |
| | 255 | 0 | 1 | 27 | 59 | 90 | 142 | 180 | 220 | 255 |

19

| | | Input image signal | | | | | | | | |
|---|---|---|---|---|---|---|---|---|---|---|
| | | 0 | 32 | 64 | 96 | 128 | 160 | 192 | 224 | 255 |
| Predicted signal | 0 | 0 | 29 | 60 | 92 | 122 | 154 | 191 | 221 | 245 |
| | 32 | 5 | 32 | 61 | 95 | 123 | 155 | 192 | 222 | 251 |
| | 64 | 20 | 31 | 64 | 96 | 123 | 156 | 192 | 222 | 254 |
| | 96 | 23 | 33 | 66 | 96 | 125 | 157 | 192 | 223 | 254 |
| | 128 | 28 | 34 | 66 | 96 | 128 | 160 | 192 | 223 | 256 |
| | 160 | 33 | 35 | 67 | 96 | 129 | 160 | 192 | 223 | 255 |
| | 192 | 34 | 35 | 67 | 97 | 129 | 160 | 192 | 223 | 255 |
| | 224 | 41 | 36 | 65 | 97 | 129 | 161 | 193 | 224 | 255 |
| | 255 | 43 | 37 | 69 | 99 | 129 | 161 | 194 | 225 | 255 |

LIQUID CRYSTAL DISPLAY APPARATUS

BACKGROUND OF THE INVENTION

The present invention relates to a liquid crystal display apparatus, and more particularly to a liquid crystal display apparatus suitably used for display of moving images.

Liquid crystal display apparatuses are used for personal computers, word processors, amusement equipment, TV sets and the like. Further study on liquid crystal display apparatuses is underway to improve their response characteristic for attainment of high-quality display of moving images.

Japanese Laid-Open Patent Publication No. 3-174186 (see FIGS. 1 to 4 of this publication) discloses a liquid crystal control circuit and a drive method for a liquid crystal panel that are adaptive to large-screen, high-resolution image display. Specifically, the publication discloses that the response time at rising of liquid crystal molecules can be shortened by comparing/operating the current voltage value being applied to the liquid crystal molecules and the voltage value to be applied in the next field with each other and correcting the voltage value based on the comparison/operation results.

The drive method for a liquid crystal panel disclosed in the above publication will be described with reference to FIG. 13. FIG. 13 shows a case that voltage data before correction changes from D1 to D5 in field F4.

As shown in FIG. 13, when voltages V1 and V5 are comparatively small, that is, close to a common voltage and the relationship of V5−V1>0 is satisfied, rising of liquid crystal molecules is slow, and thus it takes long time for the transmission amount to reach a predetermined value. Consider, for example, a reflection mode twisted nematic (TN) liquid crystal panel having a minimum voltage value of 2.0 V at which the liquid crystal layer permits no light transmission and a maximum voltage value of 3.5 V at which the liquid crystal layer permits transmission of the maximum amount of light. In this liquid crystal panel, when the applied voltage V1 is 2.0 V and the changed voltage V5 is 2.5 V, the time required for the transmission amount to reach the predetermined value is about 70 to 100 msec. Two or more fields are therefore required for the response, and this causes image smear.

As the voltage V5 is greater, the response time is shorter and will finally fall within 33 msec that is within two fields. Therefore, when the voltage V5 is less than a predetermined value, voltage data is corrected so that a voltage higher than V5 is applied in field F4 in which V5 is to be applied. To state specifically, the liquid crystal control circuit checks the voltage change amount for a given pixel by comparing data in field F3 with data in field F4, and controls a data corrector (see FIG. 2 of this publication) to correct the data in field F4 from D5 to D7, and a source drive IC (see FIG. 1 of this publication) to apply a voltage V7 to a source signal line based on the corrected voltage data D7 in field F4. In this way, the rising characteristic of the liquid crystal is improved, allowing attainment of a predetermined transmission amount T5 within one field shown by F4.

According to the liquid crystal panel described above, the response time can be improved to 20 to 30 msec by applying 3.0 to 3.5 V as the voltage V7.

In liquid crystal display apparatuses, high-speed response of liquid crystal is requested to present high-quality moving images without blurring. The response of liquid crystal can be sped up by the method disclosed in Japanese Laid-Open Patent Publication No. 3-174186 described above. However, under conditions of slow liquid crystal response, a difference arises between the transmittance of a liquid crystal panel in its steady state corresponding to the voltage value applied to the liquid crystal and the actual transmittance of the liquid crystal panel, and this causes a problem of failing in accurate correction of the voltage value. For example, in a low-temperature environment, in which the liquid crystal response speed is low, a target gray-scale level may not be attained even when it is about in the middle of the gray scale.

Moreover, in cases such as that the gray-scale level changes from a high level to a low level corresponding to a voltage value close to an extreme among the set gray-scale voltage values, and that the gray-scale level changes from a low level to a high level corresponding to a voltage value close to an extreme among the set gray-scale voltage values, the applied voltage to the liquid crystal panel is saturated, and thus a target gray-scale level may not be attained. In addition, if the voltage value correction method is low in precision, a practically usable corrected value may not be obtained, and thus a target gray-scale level may not be attained. If the next field is driven while a target gray-scale level has not been attained as described above, errors will be accumulated. As a result, image blurring may arise due to an afterimage in display of moving images, or a bright spot may be displayed at an end of a moving image.

SUMMARY OF THE INVENTION

An object of the present invention is providing a liquid crystal display apparatus capable of presenting high-quality moving images.

The liquid crystal display apparatus according to the first aspect of the present invention includes: a liquid crystal panel having a liquid crystal layer and an electrode for applying a voltage to the liquid crystal layer; and a drive circuit for supplying a drive voltage to the liquid crystal panel, wherein the drive circuit supplies a drive voltage obtained by giving an overshoot to a gray-scale voltage corresponding to an input image signal in the current vertical period, the drive voltage being determined in advance according to a combination of an input image signal in the immediately-preceding vertical period processed based on a predicted value of the transmittance of the liquid crystal panel in the immediately-preceding vertical period and the input image signal in the current vertical period.

The liquid crystal display apparatus according to the second aspect of the present invention includes: a liquid crystal panel having a liquid crystal layer and an electrode for applying a voltage to the liquid crystal layer; and a drive circuit for supplying a drive voltage to the liquid crystal panel, wherein the drive circuit supplies a drive voltage obtained by giving an overshoot to a gray-scale voltage corresponding to an input image signal in the current vertical period, the drive voltage being determined in advance according to a combination of a predicted signal corresponding to a predicted value of the transmittance of the liquid crystal panel in the immediately-preceding vertical period and the input image signal in the current vertical period.

The predicted signal in the immediately-preceding vertical period may be determined in advance according to a combination of a predicted signal processed based on a predicted value of the transmittance of the liquid crystal panel in a second immediately-preceding vertical period and an input image signal in the immediately-preceding vertical period.

The predicted signal in the immediately-preceding vertical period preferably corresponds to the transmittance of the liquid crystal panel in the current vertical period.

The liquid crystal display apparatus according to the third aspect of the present invention includes: a liquid crystal display panel for displaying an image by changing a gray-scale level to be displayed with change of a voltage level applied to a liquid crystal layer; setting means for setting at least a target gray-scale level with which it is intended to complete the optical response of the liquid crystal display panel within one vertical period for each gray-scale transition pattern of a combination of gray-scale levels corresponding to two signals; voltage application means for applying a target voltage level corresponding to the target gray-scale level set by the setting means to the liquid crystal layer; a table at least including an actual gray-scale level actually obtained by the liquid crystal display panel after one vertical period when the voltage application means applies the target voltage level to the liquid crystal layer, the actual gray-scale level being set for each gray-scale transition pattern; and correction means for correcting a target gray-scale level for an (n+1)th input image signal based on an actual gray-scale level obtained by referring to the table, for gray-scale transition from a gray-scale level of an (n−1)th input image signal to a gray-scale level of an n-th input image signal when the (n−1)th input image signal and the n-th input image signal are different in gray-scale level from each other. Note that n is a natural number equal to or more than 2.

The setting means may selectively set the target gray-scale level and a limit gray-scale level that fails to reach the target gray-scale level and can be displayed by the liquid crystal display panel, the voltage application means may selectively apply the target voltage level and a limit voltage level corresponding to the limit gray-scale level set by the setting means, and the table may include the actual gray-scale level obtained when the voltage application means selectively applies the target voltage level and the limit voltage level.

The liquid crystal display apparatus according to the fourth aspect of the present invention includes: a liquid crystal display panel for displaying an image by changing a gray-scale level to be displayed with change of a voltage level applied to a liquid crystal layer; a first table including a target gray-scale level with which it is intended to complete the optical response of the liquid crystal display panel within one vertical period for each gray-scale transition pattern as a combination of gray-scale levels corresponding to two signals; first setting means for setting the target gray-scale level by referring to the first table; voltage application means for applying a target voltage level corresponding to the target gray-scale level set by the first setting means to the liquid crystal layer; a second table including an actual gray-scale level actually obtained by the liquid crystal display panel after one vertical period when the voltage application means applies the target voltage level to the liquid crystal layer, the actual gray-scale level being set for each gray-scale transition pattern; second setting means for setting the actual gray-scale level by referring to the second table; and correction means for correcting a target gray-scale level for an (n+1)th input image signal based on an actual gray-scale level set by the second setting means, for gray-scale transition from a gray-scale level of an (n−1)th input image signal to a gray-scale level of an n-th input image signal.

The liquid crystal display apparatus according to the fifth aspect of the present invention includes: a liquid crystal display panel for displaying an image by changing a gray-scale level to be displayed with change of a voltage level applied to a liquid crystal layer; a first table including a target gray-scale level with which it is intended to complete the optical response of the liquid crystal display panel within one vertical period and a mild gray-scale level milder than the target gray-scale level, for each gray-scale transition pattern as a combination of gray-scale levels corresponding to two signals; first setting means for setting the target gray-scale level or the mild gray-scale level by referring to the first table; voltage application means for applying a target voltage level corresponding to the target gray-scale level set by the first setting means, or a mild voltage level corresponding to the mild gray-scale level set by the first setting means, to the liquid crystal layer; a second table including an actual gray-scale level actually obtained by the liquid crystal display panel after one vertical period when the voltage application means applies the target voltage level or the mild voltage level to the liquid crystal layer, the actual gray-scale level being set for each gray-scale transition pattern; second setting means for setting the actual gray-scale level by referring to the second table; and correction means for correcting a target gray-scale level for an (n+1)th input image signal based on the actual gray-scale level set by the second setting means, for gray-scale transition from a gray-scale level of an (n−1)th input image signal to a gray-scale level of an n-th input image signal.

In the fourth or fifth aspect of the present invention, the number of gray-scale transition patterns set in the first table is preferably smaller than the number of gray-scale transition patterns set in the second table.

Herein, a voltage applied to a liquid crystal layer for display in a liquid crystal display apparatus is called a gray-scale voltage Vg. For example, in display of 64 levels of gray scale from 0 (black) to 63 (white), the gray-scale voltage Vg for display of level 0 is indicated by V0, and that for display of level 63 is indicated by V63. In the case of a normally black (NB) mode liquid crystal display apparatus, which will be exemplified in embodiments of the present invention to follow, V0 is the lowest gray-scale voltage and V63 is the highest gray-scale voltage. On the contrary, in the case of a normally white (NW) mode liquid crystal display apparatus, V0 is the highest gray-scale voltage and V63 is the lowest gray-scale voltage.

A signal giving image information to be displayed in the liquid crystal display apparatus is herein called an input image signal S, and a voltage applied to a pixel in response to the input image signal S is called the gray-scale voltage Vg. Input image signals (S0 to S63) for 64 levels of gray scale have one-to-one correspondence with the gray-scale voltages (V0 to V63). Each gray-scale voltage Vg is set so that a degree of transmittance (display state) of a liquid crystal layer meant by the corresponding input image signal S is attained when the liquid crystal layer, receiving application of the gray-scale voltage Vg, reaches its steady state. The transmittance in this state is called a steady-state transmittance. The values of the gray-scale voltages V0 to V63 may vary depending on the liquid crystal display apparatus.

The liquid crystal display apparatus is driven in an interlaced manner, for example, in which one frame corresponding to one image is divided into two fields and gray-scale voltages Vg corresponding to input image signals S are applied to a display section for each field. Naturally, one frame may be divided into three or more fields, or non-interlaced drive may be adopted. In the non-interlaced drive, gray-scale voltages Vg corresponding to input image signals S are applied to the display section for each frame. One field in the interlaced drive or one frame in the non-interlaced drive is herein called one vertical period.

Comparison of input image signals S for detection of an overshoot voltage is performed between the input image signals S in the preceding vertical period and in the current vertical period for each of all pixels. In the interlaced drive in which image information of one frame is divided into a plurality of fields, an input image signal S before one frame for a relevant pixel and input image signals S on the upper and lower lines are used as complementary signals, to provide signals for all pixels during one vertical period. These input image signals S in the preceding field and the current field are compared with each other.

The difference between an overshoot gray-scale voltage Vg and a predetermined gray-scale voltage (gray-scale voltage corresponding to the input image signal S in the current vertical period) may occasionally be called an overshoot amount. The overshoot gray-scale voltage Vg may occasionally be called an overshoot voltage. The overshoot voltage may be another gray-scale voltage Vg having a given overshoot amount with respect to a given gray-scale voltage Vg, or an overshoot drive dedicated voltage prepared in advance for overshoot drive. A higher-side overshoot drive dedicated voltage and a lower-side overshoot drive dedicated voltage may be prepared as voltages with an overshoot given to the highest gray-scale voltage (gray-scale voltage having the highest voltage value among others) and the lowest gray-scale voltage (gray-scale voltage having the lowest voltage value among others), respectively.

According to the liquid crystal display apparatus of the present invention, an input image signal S in the field immediately preceding the current field is not merely recorded, but a signal processed appropriately according to the transmittance (predicted value) of a liquid crystal panel in the current field is recorded. Since this signal and an input image signal S in the current field are used for the comparison/operation, the voltage value (voltage level) can be corrected more accurately. Accordingly, occurrence of blurring of an image due to an afterimage and generation of a bright spot at an edge of a moving image can be prevented during moving image display.

BRIEF DESCRIPTION OF THE DRAWINGS

FIG. 6 is a view showing an OS parameter table in Embodiment 2.

FIG. 7 is a view showing a prediction table in Embodiment 2.

FIG. 8 is a view showing a simplified OS parameter table.

FIG. 9 is a view showing a specific example of the simplified OS parameter table.

FIG. 10 is a view showing an OS parameter table obtained by calculating gray-scale levels corresponding to gray-scale transition patterns taken every 32 gray-scale levels using the OS parameter table of FIG. 9.

FIG. 11 is a view showing an OS parameter table in a 9×9 matrix obtained by measuring gray-scale levels under the same condition as that used for the OS parameter table of FIG. 10.

DESCRIPTION OF THE PREFERRED EMBODIMENTS

Figure 1:
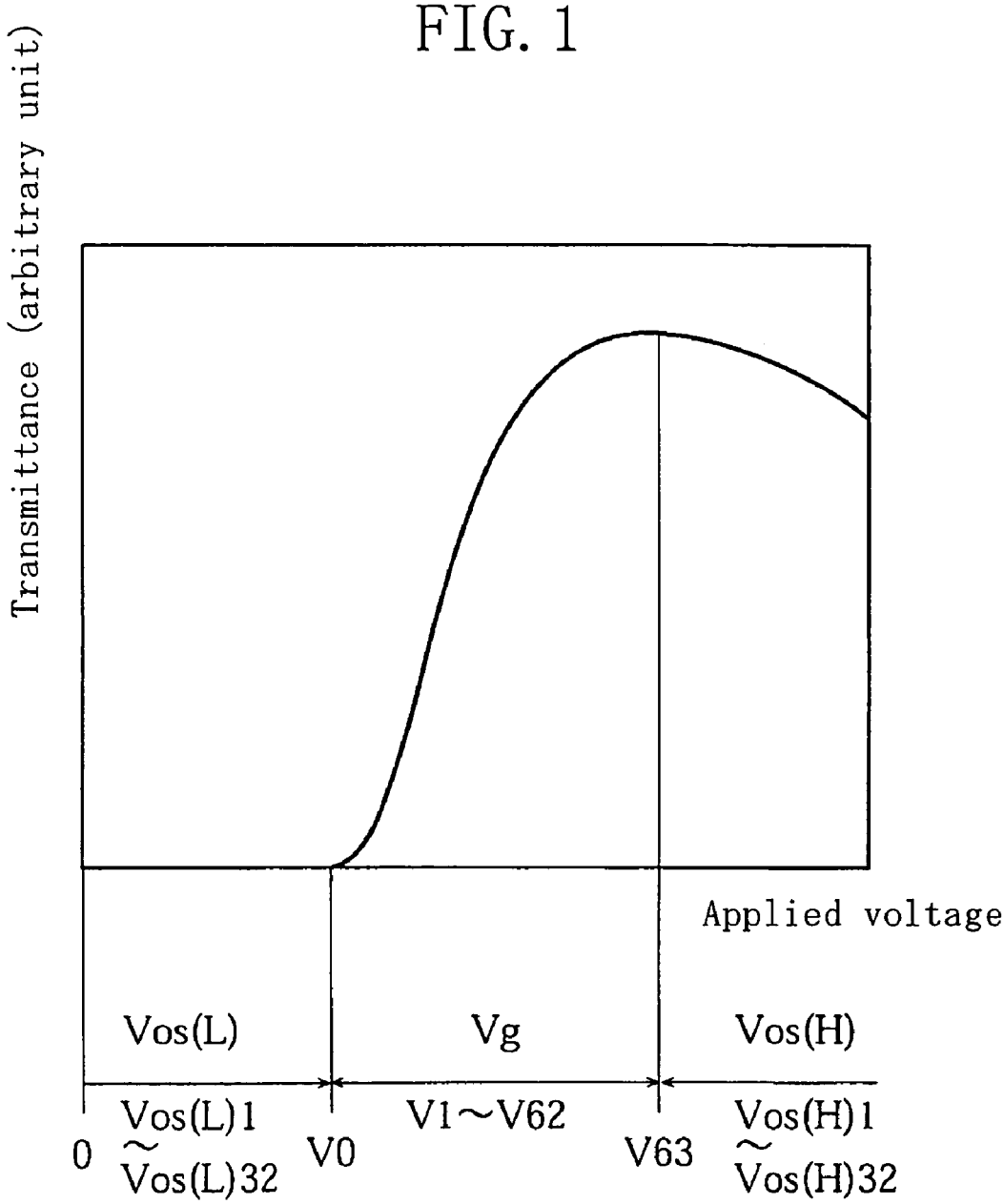
FIG. 1 is a diagrammatic view showing the relationship between the V-T curve and the overshoot drive dedicated voltage Vos and the gray-scale voltage Vg for a liquid crystal panel of a liquid crystal display apparatus of Embodiment 1 of the present invention.

Hereinafter, preferred embodiments of the present invention will be described with reference to the accompanying drawings. Herein, the embodiments will be described taking a vertically aligned NB mode liquid crystal display apparatus as an example. However, the present invention is not limited to this, but is also applicable to a horizontally aligned NB mode liquid crystal display apparatus and NW mode liquid crystal display apparatuses having a vertically aligned liquid crystal layer and a horizontally aligned liquid crystal layer, for example. Also, the embodiments will be described taking an interlaced drive type liquid crystal display apparatus in which one field corresponds to one vertical period as an example. However, the present invention is not limited to this, but is also applicable to a non-interlaced drive type liquid crystal display apparatus in which one frame corresponds to one vertical period.

Embodiment 1

(Overshoot Drive)

The overshoot drive as used herein refers to a drive method for a liquid crystal panel in which an input image signal S in the current vertical period is compared with that in the preceding vertical period (immediately-preceding vertical period), and based on the comparison result, a gray-scale voltage corresponding to the input image signal S in the current vertical period is corrected. The gray-scale voltage subjected to the comparison/correction is called an overshoot voltage. For example, when the gray-scale voltage corresponding to the input image signal S in the current vertical period is higher than the gray-scale voltage Vg corresponding to the input image signal S in the preceding vertical period, the overshoot voltage is a voltage higher than the gray-scale voltage Vg corresponding to the input image signal S in the current vertical period. In reverse, when the gray-scale voltage corresponding to the input image signal S in the current vertical period is lower than the gray-scale voltage Vg corresponding to the input image signal S in the preceding vertical period, the overshoot voltage is a voltage lower than the gray-scale voltage Vg corresponding to the input image signal S in the current vertical period.

In the liquid crystal display apparatus of the present invention, the input image signal S in the preceding vertical period is appropriately processed according to the transmittance (predicted value) of the liquid crystal panel in the current field.

(Overshoot Drive Dedicated Voltage and Gray-scale Voltage)

In the liquid crystal display apparatus of the present invention, overshoot drive dedicated voltages Vos may be set in advance in addition to the gray-scale voltages Vg (V0 to V63). The overshoot drive dedicated voltages Vos include a lower-side voltage Vos(L) lower than the gray-scale voltage Vg and a higher-side voltage Vos(H) higher than the gray-scale voltage Vg. A plurality of different voltage values may be set for each of the lower-side and higher-side voltages. The higher-side overshoot drive dedicated voltage Vos(H) (the highest one when a plurality of values are set) is set so as not to exceed the withstand voltage of a drive circuit (driver, typically a driver IC). Also, the overshoot drive dedicated voltages are set so that the number of bits for the overshoot drive dedicated voltages Vos and the gray-scale voltages Vg (V0 to V63) together does not exceed the number of bits of the drive circuit.

Hereinafter, setting of the overshoot drive dedicated voltages Vos and the gray-scale voltages Vg will be described with reference to FIG. 1. FIG. 1 shows the relationship between the voltage-transmittance (V-T) curve and the overshoot drive dedicated voltages Vos and the gray-scale voltages Vg. In this embodiment, the gray-scale voltages Vg (V0 (black) to V63) are set to fall within the range between the voltage at which the transmittance is the lowest value and the voltage at which the transmittance is the highest value. The lower-side overshoot drive dedicated voltage Vos(L) (for example, Vos(L)1 to Vos(L)32 for 32 gray-scale levels) is set to be equal to or higher than 0 V and lower than V0 (the lowest value of the gray-scale voltages Vg). The higher-side overshoot drive dedicated voltage Vos(H) (for example, Vos(H)1 to Vos(H)32 for 32 gray-scale levels) is set to be higher than V63 (the highest value of the gray-scale voltages Vg) and not to exceed the withstand voltage of the drive circuit.

The number of gray-scale levels for the gray-scale voltages Vg and that for the overshoot drive dedicated voltages Vos can be set arbitrarily as long as it does not exceed the number of bits of the drive circuit. The numbers of gray-scale levels for the lower-side and higher-side overshoot drive dedicated voltages Vos(L) and Vos(H) may be different from each other.

In this embodiment, the gray-scale voltages Vg (V0 (black) to V63) are set to fall within the range between the voltage at which the transmittance is the lowest value and the voltage at which the transmittance is the highest value. Alternatively, the voltage at which the transmittance is the lowest value may be in the range of the lower-side overshoot drive dedicated voltage Vos(L), and the voltage at which the transmittance is the highest value may be in the range of the higher-side overshoot drive dedicated voltage Vos(H).

The voltage applied during the overshoot drive is determined in advance according to the change of the input image signal S, which is either a gray-scale voltage Vg or an overshoot drive dedicated voltage Vos.

For example, when the gray-scale voltage Vg corresponding to the input image signal S in the current field is higher than the gray-scale voltage Vg corresponding to the input image signal S in the preceding field, a voltage higher than the gray-scale voltage Vg corresponding to the input image signal S in the current field, which is selected from gray-scale voltages Vg and higher-side overshoot drive dedicated voltages Vos(H), is applied to the liquid crystal panel. The voltage used for the overshoot drive is determined in advance so that a steady-state transmittance corresponding to the input image signal S in the current field is attained, or a transmittance with which the viewer does not feel strange is attained, within a predetermined time (for example, 8 msec) from application of the voltage in the current field.

The voltage used for the overshoot drive is determined for each combination of the input image signal S in the preceding field (64 gray-scale levels, for example) and the input image signal S in the current field (64 gray-scale levels) (the overshoot amount is 0 for a combination with no change in gray-scale level). Some combination of gray-scale levels may not require the overshoot drive depending on the response speed of the liquid crystal panel. The number of gray-scale levels of the overshoot drive dedicated voltages Vos may be changed appropriately.

(Circuit for Overshoot Drive: Comparative Example 1)

Figure 14:
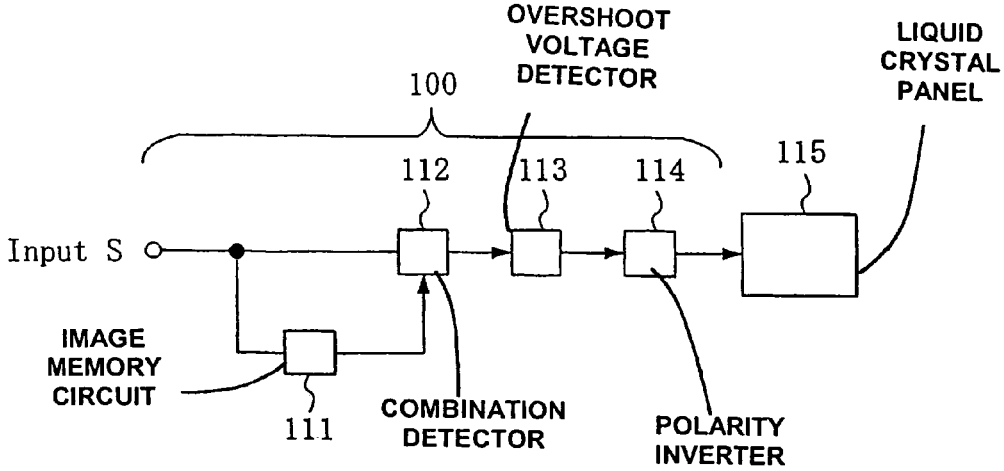
FIG. 14 is a diagrammatic view showing a configuration of a drive circuit of a liquid crystal display apparatus of Comparative Example 1.

A drive circuit 100 of a liquid crystal display apparatus of Comparative Example 1 will be described with reference to FIG. 14.

The drive circuit 100 receives an input image signal S from outside and supplies a drive voltage corresponding to the received signal to a liquid crystal display panel (also called a liquid crystal panel) 115. The drive circuit 100 includes an image memory circuit 111, a combination detector 112, an overshoot voltage detector 113 and a polarity inverter 114.

The image memory circuit 111 holds at least one field image of the input image signals S. The combination detector 112 compares the input image signal S in the current field with the input image signal S in the preceding field held in the image memory circuit 111, and outputs a signal indicating the combination of the two signals to the overshoot voltage detector 113. The overshoot voltage detector 113 detects a drive voltage corresponding to the combination detected by the combination detector 112 from gray-scale voltages Vg and overshoot drive dedicated voltages Vos. The polarity inverter 114 converts the drive voltage detected by the overshoot voltage detector 113 to an AC signal and supplies the resultant signal to the liquid crystal panel (display section) 115.

The overshoot drive operation with an overshoot drive dedicated voltage Vos by the liquid crystal display apparatus of Comparative Example 1 will be described. For example, the overshoot voltage detector 113 can detect a drive voltage for given overshoot drive, according to each of 64 gray-scale levels (six bits) of the input image signal S, from signals of seven bits (64 gray-scale voltages Vg (V0 to V63) and 64 overshoot voltages Vos (higher-side voltages Vos(H)1 to Vos(H)32 and lower-side voltages Vos(L)1 to Vos(L)32)).

In the rising of liquid crystal molecules, suppose the input image signal S changes from S40 to S63 after one field, for example. The input image signal S40 is held in the image memory circuit 111. The combination detector 112 detects a combination (S40, S63). The overshoot voltage detector 113 detects an overshoot drive dedicated voltage Vos(H)20, for example, which is determined in advance so that a steady-state transmittance corresponding to the input image signal S63 is attained within one field, and supplies the voltage Vos(H)20 to the polarity inverter 114 as the drive voltage. The polarity inverter 114 converts the voltage Vos(H)20 to an AC voltage and supplies the resultant voltage to the liquid crystal panel 115.

(Circuit for Overshoot Drive: Embodiment 1)

In general, the transmittance of a liquid crystal panel in the current field agrees with the transmittance defined by the input image signal S in the field preceding the current field by one field (immediately-preceding field). Therefore, in Comparative Example 1, the input image signal S in the immediately-preceding field is held in the image memory circuit 111.

However, in general, the response time of a liquid crystal panel greatly varies with an environmental condition, a drive condition and the like. For example, in a low-temperature environment, even application of an overshoot voltage may fail to attain a desired transmittance. In this case, the transmittance of the liquid crystal panel 115 is different from the transmittance defined by the input image signal S in the immediately-preceding field held by the image memory circuit 111, and thus an error occurs in the overshoot voltage to be applied in the next field.

To solve the above problem, a signal appropriately processed according to the transmittance of the liquid crystal panel in the current field may be held, not simply holding the input image signal S in the immediately-preceding field. For example, in one method, a transmittance to be attained with an overshoot voltage within the current field may be predicted, and a signal corresponding to the predicted transmittance may be recorded as the signal in the immediately-preceding field.

Figure 2:
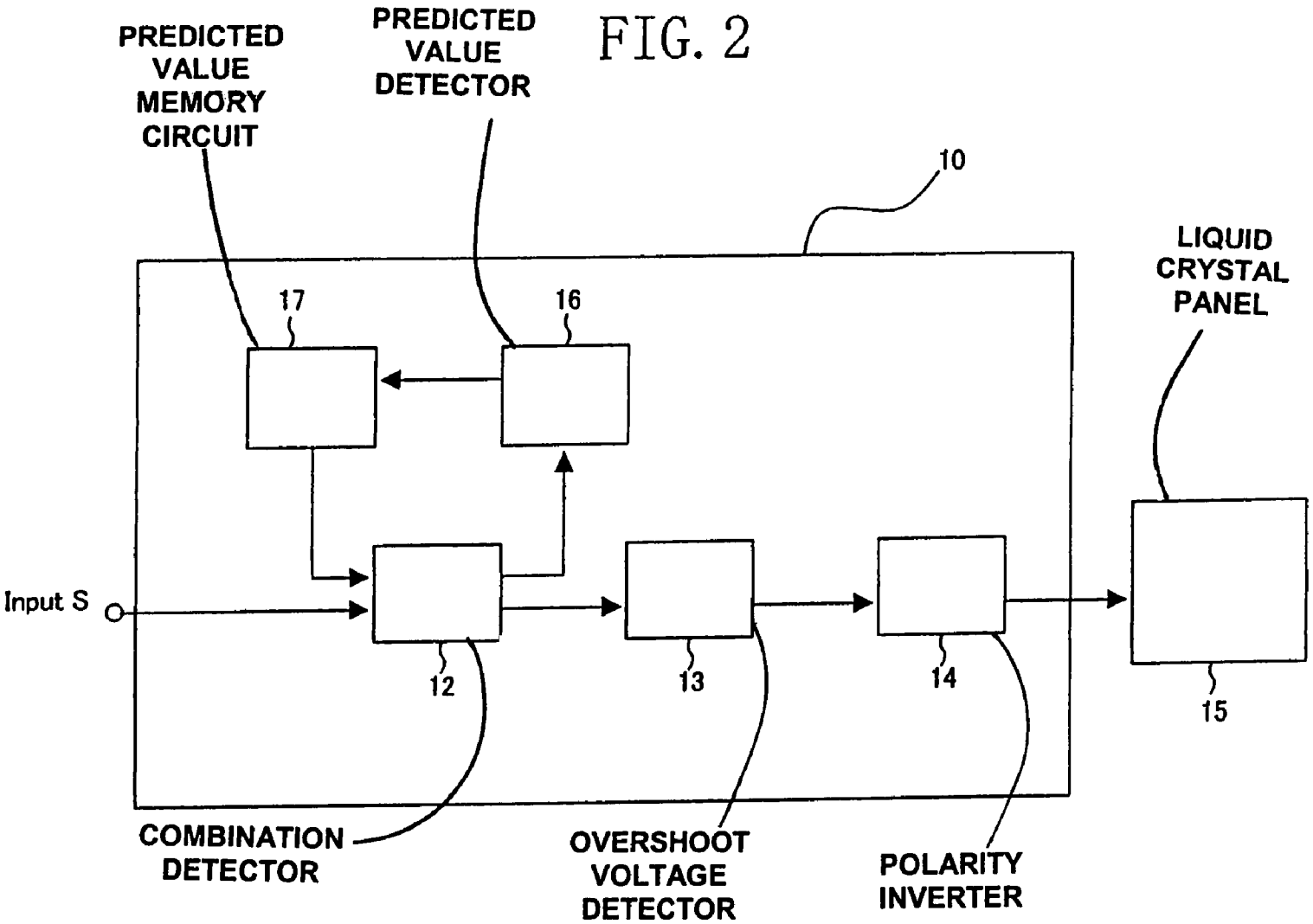
FIG. 2 is a diagrammatic view showing a configuration of a drive circuit of the liquid crystal display apparatus of Embodiment 1 of the present invention.

An appropriate combination of circuits for realizing the method described above will be described specifically with reference to FIG. 2. FIG. 2 is a diagrammatic view showing a configuration of a drive circuit 10 of a liquid crystal display apparatus of Embodiment 1 of the present invention. In FIG. 2, portions of the drive circuit 10 unnecessary for the description are omitted.

The drive circuit 10 receives an input image signal S from outside and supplies a drive voltage corresponding to the received signal to a liquid crystal panel 15. The drive circuit 10 includes a combination detector 12, an overshoot voltage detector 13, a polarity inverter 14, a predicted value detector 16 and a predicted value memory circuit 17.

The combination detector 12 compares a predicted signal held in the predicted value memory circuit 17 with the input image signal in the current field, and outputs a signal representing the combination of the two signals to the predicted value detector 16 and the overshoot voltage detector 13. The predicted value detector 16 detects a predicted signal (predicted value) corresponding to the combination detected by the combination detector 12.

The predicted value memory circuit 17 holds the predicted signal (predicted value) detected by the predicted value detector 16. The held predicted signals (predicted values) correspond to at least one field image of the input image signals. In the case that one frame is not divided into a plurality of fields, the predicted value memory circuit 17 holds predicted signals (predicted values) corresponding to at least one frame image.

The overshoot voltage detector 13 detects a drive voltage corresponding to the combination detected by the combination detector 12 from gray-scale voltages Vg and overshoot drive dedicated voltages Vos. The polarity inverter 14 converts the drive voltage detected by the overshoot voltage detector 13 to an AC signal and supplies the resultant signal to the liquid crystal panel (display section) 15.

Detection of the predicted signal by the predicted value detector 16 will be described over two fields. Suppose the input image signal for a given pixel changes in the order of S0, S128 and S128 with change of the field, for example.

In the first field, when the input image signal for the given pixel in the current field is S128, the predicted value memory circuit 17 holds a signal S0 for the same pixel. The combination detector 12 detects the combination (S0, S128) of the predicted signal S0 held by the predicted value memory circuit 17 and the input image signal S128 in the current field. The predicted value detector 16 detects a predetermined predicted signal S64 based on the combination (S0, S128) detected by the combination detector 12, and the predicted value memory circuit 17 holds the predicted signal S64.

The overshoot voltage detector 13 detects a predetermined gray-scale voltage V160 based on the combination (S0, S128) detected by the combination detector 12, and supplies the gray-scale voltage V160 to the polarity inverter 14 as the drive voltage. No overshoot will be given to the drive voltage when the input image signal S has no change. For example, when the combination detector 12 detects (S40, S40), the overshoot voltage detector 13 outputs a gray-scale voltage V40 corresponding to the signal S40 to the polarity inverter 14 as the drive voltage.

Subsequently, in the second field, in which the input image signal is S128, the combination detector 12 detects the combination (S64, S128) of the predicted signal S64 held by the predicted value memory circuit 17 and the input image signal S128 in the current field. The predicted value detector 16 detects a predetermined predicted signal S96 based on the combination (S64, S128) detected by the combination detector 12, and the predicted value memory circuit 17 holds the predicted signal S96. The overshoot voltage detector 13 detects a predetermined gray-scale voltage V148 based on the combination (S64, S128) detected by the combination detector 12, and supplies the gray-scale voltage V148 to the polarity inverter 14 as the drive voltage.

The predicted signal detected by the predicted value detector 16 is preferably a signal corresponding to the transmittance obtained one field after the application of the gray-scale voltage detected by the overshoot voltage detector 13. In other words, the predicted signal in the immediately-preceding vertical period is preferably a signal corresponding to the transmittance of the liquid crystal panel in the current vertical period.

As described above, in the drive circuit 10 having the predicted value detector 16 and the predicted value memory circuit 17, when the input image signal for a given pixel changes in the order of S0, S128 and S128 with change of the field, the gray-scale voltages for the respective signals are V0, V160 and V148, and this permits overshoot drive over the sequential fields. This sequential overshoot drive is effective when the response speed is so low that a target transmittance is not attained within one field even with application of an overshoot voltage.

Figure 3:
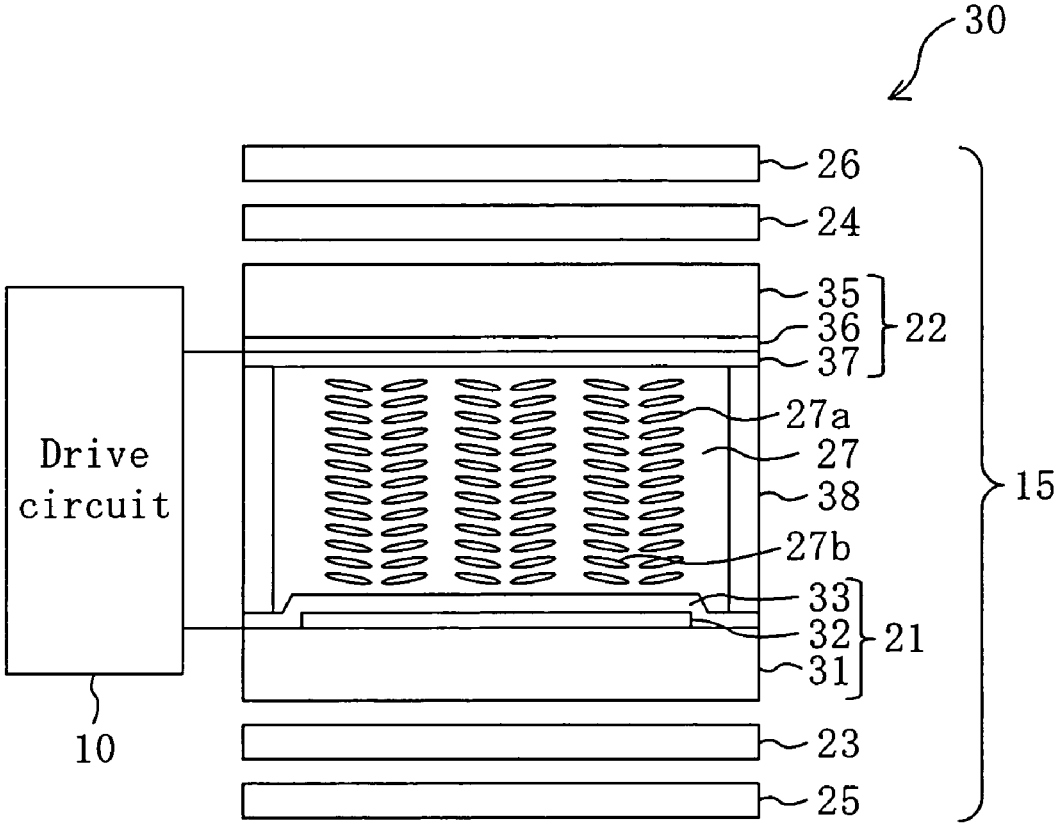
FIG. 3 is a view diagrammatically showing the liquid crystal display apparatus of Embodiment 1 of the present invention.

FIG. 3 is a diagrammatic cross-sectional view of the liquid crystal display apparatus of this embodiment (during application of a voltage). The liquid crystal display apparatus 30 of this embodiment, which is an NB mode liquid crystal display apparatus having a vertically aligned liquid crystal layer, includes the drive circuit 10 and the liquid crystal panel 15 shown in FIG. 2.

The liquid crystal panel 15 includes a thin film transistor (TFT) substrate 21 and a color filter (CF) substrate 22. These substrates may be fabricated by known methods. The liquid crystal display apparatus 30 of the present invention is not necessarily of the TFT type. For attainment of high response speed, however, active matrix liquid crystal display apparatuses of the TFT type, a metal insulator metal (MIM) type and the like are preferred.

In the TFT substrate 21, pixel electrodes 32 made of indium tin oxide (ITO) are formed on a glass plate 31, and an alignment film 33 is formed over the surface of the glass plate 31 facing a liquid crystal layer 27. In the CF substrate 22, a counter electrode (common electrode) 36 made of ITO is formed on a glass plate 35, and an alignment film 37 is formed over the surface of the glass plate 35 facing the liquid crystal layer 27.

Although not shown, electrode slits and concaves/convexes for regulating the direction of alignment of liquid crystal molecules 27*a* and 27*b* may be provided, to enable control of the direction of tilt of the liquid crystal molecules 27*a* and 27*b* during application of a voltage using the electric field and the pretilt angle. The alignment of the liquid crystal molecules 27*a* and 27*b* are diagrammatically shown in FIG. 3, in which the liquid crystal molecules 27*a* and 27*b* fall in different directions (typically by 180°). By forming a plurality of regions different in the direction of alignment of the liquid crystal molecules 27*a* and 27*b* within one pixel region in this way, the display characteristic can be averaged in smaller units, and thus uniform viewing angle characteristic is attained.

The alignment films 33 and 37, which are vertical alignment films having the nature of vertically aligning the liquid crystal molecules 27*a* and 27*b*, are formed from a polyimide film that is an organic polymer film, for example. The surfaces of the alignment films 33 and 37 are rubbed in one direction. The TFT substrate 21 and the CF substrate 22 are bonded together so that the rubbing directions are in anti-parallel to each other. A nematic liquid crystal material having negative dielectric constant anisotropy $\Delta\epsilon$ is injected in the space between the substrates 21 and 22, to obtain the vertically aligned liquid crystal layer 27. The liquid crystal layer 27 is sealed with a sealing material 38.

Phase compensators 23 and 24 are bonded to the outer surfaces of the TFT substrate 21 and the CF substrate 22, respectively, so that the rubbing directions and the slower axes of the phase compensators 23 and 24 are orthogonal to each other. A pair of polarizers (for example, polarizing plates and polarizing films) 25 and 26 are placed so that the absorption axes thereof are orthogonal to each other and form an angle of 45° with the rubbing directions described above.

Hereinafter, a specific configuration of the drive circuit 10 will be described with reference to FIG. 2. Assume that the input image signal S has six bits (64-level gray scale) and is a progressive signal with 60 Hz per field. The combination detector 12 detects a signal (combination signal) representing the combination of the predicted signal held by the predicted value memory circuit 17 and the current input image signal S. The detected combination signal is output to the overshoot voltage detector 13 and the predicted value detector 16.

The overshoot voltage detector 13 detects a predetermined drive voltage corresponding to the combination signal detected by the combination detector 12 from signals of seven bits (lower-side overshoot drive dedicated voltage: 32 gray-scale levels in the range of 0 V to 2 V, gray-scale voltage: 64 gray-scale levels in the range of 2.1 V to 5 V, and higher-side overshoot drive dedicated voltage: 32 gray-scale levels in the range of 5.1 V to 7 V). The drive voltage (signal) detected, which is 60 Hz, is converted to an AC signal and then supplied to the liquid crystal panel 15.

The predicted value detector 16 detects a predetermined predicted value of the transmittance corresponding to the combination signal detected by the combination detector 12. The detected predicted signal (predicted value) is held by the predicted value memory circuit 17 and then output to the combination detector 12, to be compared (combined) with the input image signal in the next field.

Figure 4:
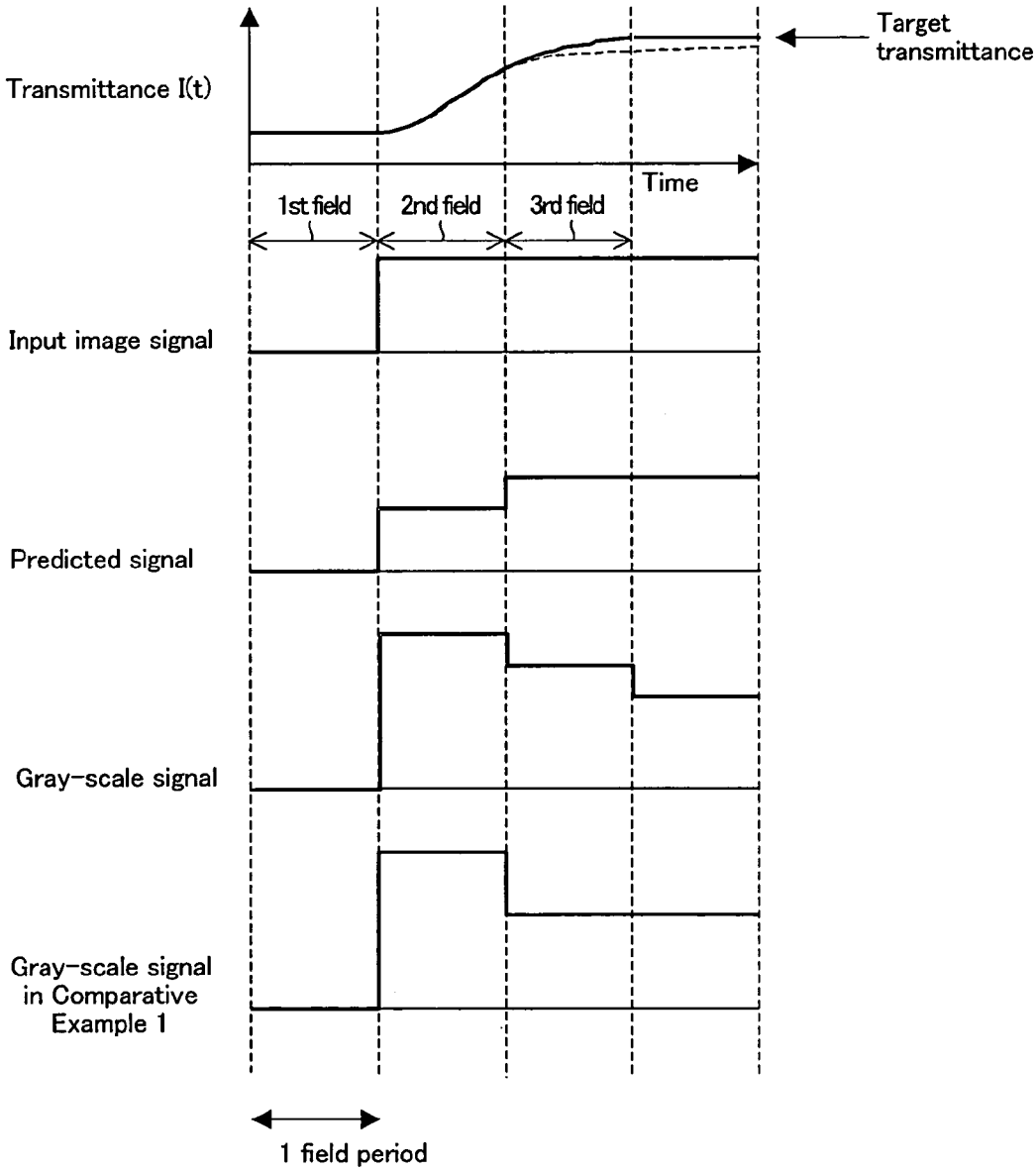
FIG. 4 is a view demonstrating the response characteristic of the liquid crystal display apparatus of Embodiment 1, in which an input image signal S, a transmittance I(t), a predicted signal and a gray-scale signal are shown, together with the response characteristic of Comparative Example 1.

FIG. 4 shows the response characteristic (transmittance I(t)) of the liquid crystal display apparatus 30 of this embodiment by the solid line. FIG. 4 also shows the response characteristic (transmittance I(t)) in Comparative Example 1 by the broken line. In Comparative Example 1, the overshoot drive is performed by comparing the input image signal in the preceding (immediately-preceding) vertical period with the input image signal S in the current vertical period. No processing based on the transmittance of the liquid crystal panel in the current field is performed for the input image signal in the preceding vertical period.

In this embodiment, the signal level sharply changes in the second field, and overshoot voltages are applied in the second and third fields. By this processing, the optical response characteristic I(t) is improved as shown by the solid line, compared with the case of Comparative Example 1.

Embodiment 2

Figure 5:
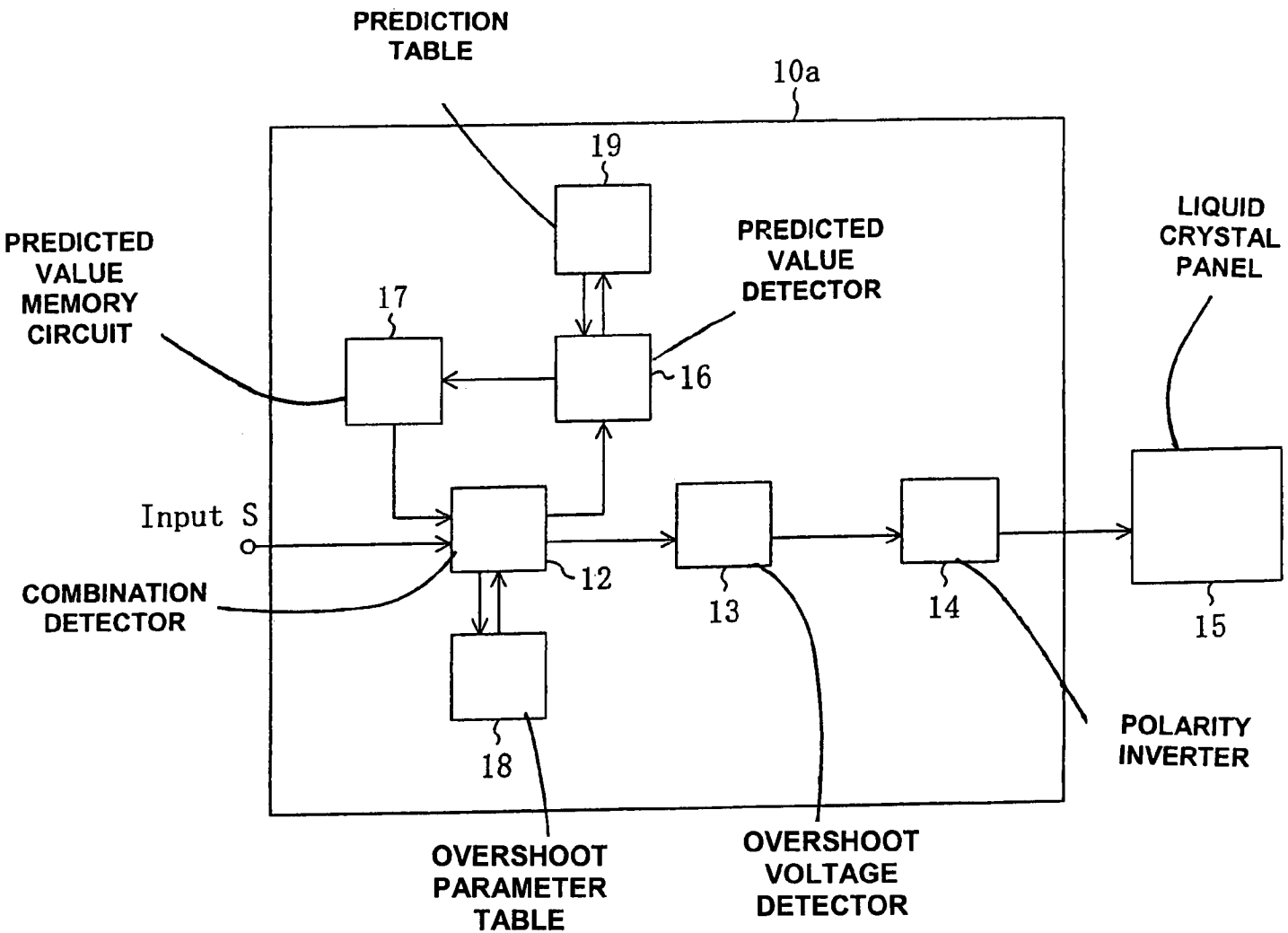
FIG. 5 is a diagrammatic view showing a configuration of a drive circuit of a liquid crystal display apparatus of Embodiment 2 of the present invention.

FIG. 5 is a diagrammatic view showing a configuration of a drive circuit 10*a* of a liquid crystal display apparatus of Embodiment 2 of the present invention. In FIG. 5, portions of the drive circuit 10*a* unnecessary for the description are omitted. Note herein that the gray-scale level corresponding to a signal S may also be expressed by S for convenience in some cases. For example, the gray-scale level corresponding to a signal S128 may be expressed by S128.

The drive circuit 10*a* receives an input image signal S from outside and supplies a drive voltage corresponding to the received signal to a liquid crystal panel 15. The drive circuit 10*a* includes a combination detector 12, an overshoot voltage detector 13, a polarity inverter 14, a predicted value detector 16, a predicted value memory circuit 17, an overshoot (OS) parameter table 18 and a prediction table 19. Each of the OS parameter table 18 and the prediction table 19 is a set of information on gray-scale levels stored in a memory circuit.

The combination detector 12 compares a predicted signal held by the predicted value memory circuit 17 with the current input image signal S and outputs a signal (combination signal) representing the combination of these signals to the predicted value detector 16. The combination detector 12 also detects a gray-scale level corresponding to this combination by referring to the OS parameter table 18, and outputs the result to the overshoot voltage detector 13. The overshoot predicted value detector 16 detects a predicted value (gray-scale level) corresponding to the combination signal detected by the combination detector 12 by referring to the prediction table 19. Herein, the gray-scale levels set in the OS parameter table 18 are also called "OS parameters".

The predicted value memory circuit 17 holds the signal detected by the predicted value detector 16. The held predicted signals correspond to at least one field image of the input image signal S. In the case that one frame is not divided into a plurality of fields, the predicted value memory circuit 17 holds signals corresponding to at least one frame image.

The overshoot voltage detector 13 detects a drive voltage corresponding to the OS parameter output from the combination detector 12 from the gray-scale voltages Vg and the overshoot drive dedicated voltages Vos. The polarity inverter 14 converts the drive voltage detected by the overshoot voltage detector 13 to an AC signal and supplies the result to the liquid crystal panel (display section) 15.

The OS parameter table 18 includes a target gray-scale level set for each gray-scale transition pattern as a combination of gray-scale levels corresponding to two signals. The target gray-scale level is a gray-scale level with which it is intended to complete the optical response of the liquid crystal panel 15 within one field. The OS parameter table 18 also includes a limit gray-scale level that fails to reach a target gray-scale level and can be displayed on the liquid crystal panel 15. In other words, the limit gray-scale level is a high gray-scale level corresponding to a voltage value close to the maximum among the set gray-scale voltage values or a low gray-scale level corresponding to a voltage value close to the minimum among the set gray-scale voltage values, in an NB mode liquid crystal display apparatus. In an NW mode liquid crystal display apparatus, the limit gray-scale level is a low gray-scale level corresponding to a voltage value close to the maximum among the set gray-scale voltage values or a high gray-scale level corresponding to a voltage value close to the minimum among the set gray-scale voltage values.

FIG. 6 is a view showing the OS parameter table 18 in this embodiment. In the OS parameter table 18, target gray-scale levels and limit gray-scale levels corresponding to overshoot voltages are recorded for typical gray-scale transition patterns taken every 32 gray-scale levels. For the other gray-scale transition patterns, gray-scale levels can be obtained from the gray-scale levels shown in the table 18 by calculation.

Referring to FIG. 6, the target gray-scale levels and the limit gray-scale levels will be described specifically. Each target gray-scale level is a gray-scale level with which it is intended to complete the optical response of the liquid crystal panel 15 within one field, and is set to correspond to each combination of the gray-scale level corresponding to the predicted signal held by the predicted value memory circuit 17 and the gray-scale level corresponding to the input image signal in the current field. In other words, the target gray-scale levels are set for respective gray-scale transition patterns. For example, a target gray-scale level S147 is set for a combination (S96, S128) of a signal S96 held by the predicted value memory circuit 17 and an input image signal S128 in the current field.

However, for some combinations (gray-scale transition patterns) of the predicted signal and the input image signal, a gray-scale level falling short of a target gray-scale level is forced to be set although reluctantly. For example, when the gray-scale level changes from a low gray-scale level to a high gray-scale level corresponding to a voltage value close to the maximum among the set gray-scale voltage values (for example, from S0 to S255), or when the gray-scale level changes from a high gray-scale level to a low gray-scale level corresponding to a voltage value close to the minimum among the set gray-scale voltage values (for example, from S255 to S0), a gray-scale level falling short of a target gray-scale level is forced to be set in some cases. The reason is that in the liquid crystal panel 15, which provides 256-level gray scale, any one of the gray-scale levels from 0 (black) to 255 (white) that can be displayed by the liquid crystal panel 15 must be set although reluctantly in some cases. For example, the upper-limit gray-scale level S255 must be set for the transition from S0 to S255. Likewise, the lower-limit gray-scale level S0 must be set for the transition from S255 to S0. Application of a gray-scale voltage corresponding to such a gray-scale level S0 or S255 to the liquid crystal panel 15 will not succeed in attaining an intended gray-scale level because the applied voltage has been saturated. In other words, for some gray-scale transition patterns, a limit gray-scale level that falls short of a target gray-scale level and can be displayed by the liquid crystal panel 15 is forced to be set although reluctantly.

As described above, each OS parameter stored in the OS parameter table 18 is a target gray-scale level determined so that a target level of gray scale is attained after one field, or a limit gray-scale level falling short of a target gray-scale level. However, in some gray-scale transition patterns, a target gray-scale level may not be attained after one field even when the set target gray-scale level is used because of slow response of liquid crystal. In this embodiment, a predicted value of the gray-scale level actually obtained in the current field is determined from the prediction table 19, and based on the predicted value, the input image signal in the next field is corrected.

The prediction table 19 includes an actual gray-scale level for each gray-scale transition pattern, which is actually obtained by the liquid crystal panel 15 after one field when the overshoot voltage detector 13 applies a target voltage level or a limit voltage level to the liquid crystal panel 15 via the polarity inverter 14. The target voltage level is a voltage value corresponding to the target gray-scale level, and the limit voltage level is a voltage value corresponding to the limit gray-scale level. The target voltage level and the limit voltage level are selectively applied according to the gray-scale transition pattern.

FIG. 7 is a view showing the prediction table 19 in this embodiment. In the prediction table 19, a gray-scale level obtained with an overshoot voltage within the same field is recorded for each of typical gray-scale transition patterns taken every 32 gray-scale levels. For example, when a target voltage level corresponding to the target gray-scale level S147, which is detected for the combination (S96, S128) of the predicted signal S96 and the input image signal S128 by referring to the OS parameter table 18, is applied, the actual gray-scale level actually obtained after one field is S125. In the prediction table 19 of FIG. 7, the actual gray-scale level S125 is recorded in association with the combination (S96, S128). The gray-scale levels recorded in the table 19 are obtained by actual measurement in advance. For the other gray-scale transition patterns, gray-scale levels can be obtained from the gray-scale levels recorded in the table 19 by calculation.

The operation of the drive circuit 10*a* in this embodiment will be described over two fields. Assume that the input image signal has eight bits. Suppose the input image signal S for a given pixel changes in the order of S255, S64 and S128 with change of the field, for example.

In the first field, when the input image signal for a given pixel in the current field is S64, the predicted value memory circuit 17 holds a signal S255 for the same pixel. The combination detector 12 detects the combination (S255, S64) of the signal S255 held by the predicted value memory circuit 17 and the input image signal S64 in the current field. The combination detector 12 further detects an OS parameter S0 corresponding to this combination from the OS parameter table 18, and outputs the result to the overshoot voltage detector 13. That is, the combination detector 12 sets the OS parameter S0 corresponding to the combination (S255, S64) of the predicted signal S255 and the input image signal S64 based on the OS parameter table 18. In other words, the combination detector 12 serves as a setting means for selectively setting the target gray-scale level and the limit gray-scale level for each gray-scale transition pattern.

The overshoot voltage detector 13 detects a gray-scale voltage V0 corresponding to the OS parameter S0, and supplies the gray-scale voltage V0 to the polarity inverter 14 as the drive voltage. The polarity inverter 14 converts the drive voltage (gray-scale voltage V0) detected by the overshoot voltage detector 13 to an AC signal and supplies the signal to the liquid crystal panel 15. In other words, the overshoot voltage detector 13 and the polarity inverter 14 together serve as a voltage application means for selectively applying a target voltage level corresponding to the target gray-scale level set by the setting means (combination detector 12) and a limit voltage level corresponding to the limit gray-scale level set by the setting means (combination detector 12).

The predicted value detector 16 detects a predicted signal S134 from the prediction table 19 based on the combination (S255, S64) detected by the combination detector 12, and the predicted value memory circuit 17 holds the predicted signal S134.

Subsequently, in the second field, in which the input image signal is S128, the combination detector 12 detects the combination (S134, S128) of the predicted signal S134 held by the predicted value memory circuit 17 and the input image signal S128 in the current field, then detects an OS parameter S120 corresponding to this combination from the OS parameter table 18 by calculation, and outputs the result to the overshoot voltage detector 13. The overshoot voltage detector 13 detects a gray-scale voltage V120 corresponding to the OS parameter S120, and supplies the gray-scale voltage V120 to the polarity inverter 14 as the drive voltage.

The predicted value detector 16 detects a predicted signal S128 from the prediction table 19 by calculation based on the combination (S134, S128) detected by the combination detector 12, and the predicted memory circuit 17 holds the predicted signal S128.

The detection operation by the combination detector 12 will be described in more detail. In the illustrated example, transition in gray scale takes place from the gray-scale level (S255) of the (n−1)th input image signal to the gray-scale level (S64) of the n-th input image signal. That is, the gray-scale level is different between the (n−1)th and n-th input image signals. In this case, the OS parameter S0 corresponding to the combination (S255, S64) of the (n−1)th input image signal and the n-th input image signal is different from the predicted signal S134 corresponding to the combination (S255, S64) in gray-scale level. This indicates that even if the n-th input image signal S64 is corrected and a voltage corresponding to the corrected n-th input image signal (OS parameter) S0 is applied to change the gray-scale level from S255 to S64 with the n-th input image signal, the actual gray-scale level actually obtained after one field is S134.

To attain S128 as the target gray-scale level with the (n+1)th input image signal, the (n+1)th input image signal S128 is preferably corrected based on the actual gray-scale level S134 actually obtained. Therefore, the combination detector 12 detects an OS parameter S120 corresponding to the combination (S134, S128) from the OS parameter table 18 by calculation, and outputs the result to the overshoot voltage detector 13.

From the description described above, the combination detector 12 can be a correction means for correcting the target gray-scale level for the (n+1)th input image signal (S128) based on the actual gray-scale level (S134) obtained by referring to the prediction table 19, for gray-scale transition from the gray-scale level (S255) of the (n−1)th input image signal to the gray-scale level (S64) of the n-th input image signal when the gray-scale level is different between the (n−1)th input image signal and the n-th input image signal. Whether or not the gray-scale level is different between the (n−1)th input image signal and the n-th input image signal is determined by the combination detector 12, for example. In place of the comparison between the (n−1)th and n-th input image signals, or together with this comparison, the OS parameter and the predicted signal (actual gray-scale level) may be compared with each other, or the n-th input image signal and the predicted signal (actual gray-scale level) may be compared with each other.

When the (n−1)th input image signal and the n-th input image signal are the same in gray-scale level, indicating that there is no change in gray-scale level, all of the (n−1)th input image signal (gray-scale level), the n-th input image signal (gray-scale level), the OS parameter and the predicted signal (actual gray-scale level) have the same value. For example, when the (n−1)th input image signal is S128 and the n-th input image signal is S128, it is found that the OS parameter is S128 from the OS parameter table 18 of FIG. 6, and that the predicted signal (actual gray-scale level) is S128 from the prediction table 19 of FIG. 7. When the (n−1)th and n-th input image signals are the same in gray-scale level, that is, when the OS parameter and the predicted signal (actual gray-scale level) have the same value as described above, the target gray-scale level for the (n+1)th input image signal may be corrected based on the OS parameter.

As described above, for transition from a high gray-scale level to a low gray-scale level (for example, from S255 to S0) and for transition from a low gray-scale level to a high gray-scale level (for example, from S0 to S255), the target gray-scale level may not be attained in some cases because the applied voltage to liquid crystal panel 15 is saturated. Also, in a low-temperature environment, in which the liquid crystal response speed is low, a target gray-scale level may not possibly be attained even when it is about in the middle of the gray scale. In this embodiment, the input image signal in the next field is corrected based on the predicted value of the gray-scale level actually obtained in the current field. Therefore, the error between a target gray-scale level and the actually obtained gray-scale level diminishes.

In this embodiment, the combination detector 12 sets the OS parameter by referring to the OS parameter table 18. Alternatively, the OS parameter table may be omitted and the OS parameter may be set only by calculation.

In this embodiment, gray-scale levels are recorded in the OS parameter table 18 for typical gray-scale transition patterns every 32 gray-scale levels. Alternatively, an OS parameter table having gray-scale levels for gray-scale transition patterns every gray-scale level may be used. For example, for a liquid crystal panel with 256-level gray scale, an OS parameter table in a 256×256 matrix may be used. Use of such a detailed OS parameter table provides advantages that setting of the OS parameter by calculation is unnecessary and that the precision increases. This has however a shortcoming of taking time and labor to prepare the OS parameter table. This shortcoming will be described in detail in Embodiment 3.

Comparative Example 2

Figure 15:
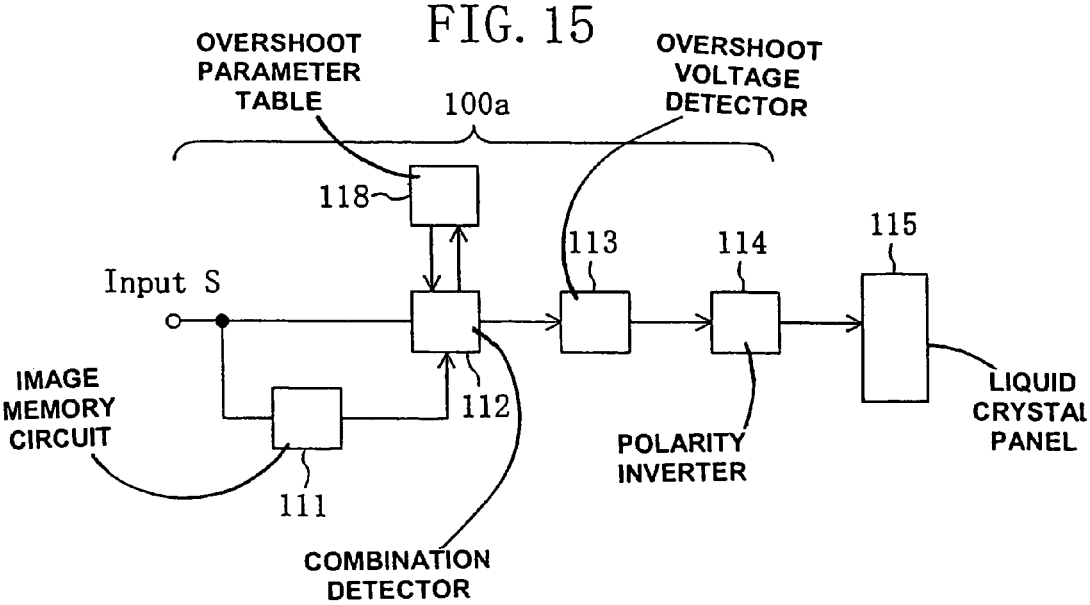
FIG. 15 is a diagrammatic view showing a configuration of a drive circuit of a liquid crystal display apparatus of Comparative Example 2.

FIG. 15 is a diagrammatic view showing a configuration of a drive circuit 100*a* of a liquid crystal display apparatus of Comparative Example 2. Components having substantially the same functions as those in Comparative Example 1 are denoted by the same reference numerals, and the description thereof is omitted here. The 9×9 matrix table of FIG. 6 is used as the OS parameter table in this comparative example, in which the "predicted signal" and the "input image signal" in FIG. 6 should be read as the "input image signal in the preceding field" and the "input image signal in the current field", respectively.

The drive circuit 100*a* has an OS parameter table 118 as in Embodiment 2. In this comparative example, the drive circuit 100*a* compares an input image signal S in the preceding vertical period (immediately-preceding vertical period) with an input image signal S in the current vertical period and refers to the OS parameter table 118 to perform overshoot drive. In this comparative example, therefore, no processing based on the transmittance of the liquid crystal panel 115 in the current field is performed for the input image signal S in the preceding vertical period.

As in Embodiment 2, suppose the input image signal for a given pixel changes in the order of S255, S64 and S128 with change of the field. In the first field, when the input image signal in the current field is S64, the image memory circuit 111 holds a signal S255 in the preceding field for the same pixel. The combination detector 112 detects the combination (S255, S64) of the input image signals in the preceding field and the current field, then detects an OS parameter S0 corresponding to this combination from the OS parameter table 118, and outputs the result to the overshoot voltage detector 113. The overshoot voltage detector 113 detects a gray-scale voltage V0 corresponding to the OS parameter S0.

In the second field, in which the input image signal is S128, the combination detector 112 detects the combination (S64, S128) of the input image signal S64 in the preceding field held by the image memory circuit 111 and the input image signal S128 in the current field, then detects an OS parameter S176 corresponding to this combination from the OS parameter table 118, and outputs the result to the overshoot voltage detector 113. The overshoot voltage detector 113 detects a gray-scale voltage V176 corresponding to the OS parameter S176, and supplies the gray-scale voltage V176 to the polarity inverter 114 as the drive voltage.

The OS parameter detected by the combination detector in Comparative Example 2 is different from that in Embodiment 2 when the input image signal S changes in the same way. Specifically, while the OS parameter changes from S0 to S120 over two fields in Embodiment 2, it changes from S0 to S176 in Comparative Example 2. In Comparative Example 2, with the greater increase of the OS parameter in the second field than in Embodiment 2, the transmittance of the liquid crystal layer for the given pixel increases. Therefore, the image displayed on the liquid crystal display apparatus of Comparative Example 2 is brighter than original in the portion of this pixel, and this makes the viewer feel strange.

Embodiment 3

The liquid crystal display apparatus of this embodiment has a drive circuit substantially the same as the drive circuit 10*a* in Embodiment 2. Description of the configuration and operation of the drive circuit are therefore omitted here. In this embodiment, however, the OS parameter table 18 and the prediction table 19 are different from those in Embodiment 2.

To determine an OS parameter correctly, the gray-scale level must be measured actually for each gray-scale pattern. For example, to specify a gray-scale voltage permitting attainment of a target gray-scale level within one field, measurement must be repeated with varying voltages. This measurement requires time and labor and causes increase of the production cost.

In this embodiment, to save time and labor, a small-size OS parameter table 18*a*, that is, a simplified OS parameter table 18*a* is used, and for gray-scale transition patterns having no entry in the table, OS parameters are determined from gray-scale levels recorded in the table 18*a* by calculation.

FIG. 8 shows an example of the simplified OS parameter table 18*a*. Using the table 18*a* of FIG. 8, a gray-scale level may be calculated for a gray-scale transition pattern having no entry in this table in the following manner.

Assume that (predicted signal, input image signal)=(a0, b0) wherein a=(remainder of division of a0 by 128) and b=(remainder of division of b0 by 128). For example, when a0<128 and b0<128, a=a0 and b=b0. If a≦b, OS parameter=A+[(B−A)×b+(E−B)×a]/128. If a>b, OS parameter=A+[(D−A)×a+(E−D)×b]/128.

FIG. 9 shows a specific example of the simplified OS parameter table 18*a*. The calculation of a gray-scale level from the OS parameter table 18*a* as a 3×3 matrix table will be described with reference to FIG. 9. In the table 18*a*, gray-scale levels corresponding to overshoot voltages are recorded for typical gray-scale transition patterns every 128 gray-scale levels. Using the table 18*a*, the gray-scale level for a gray-scale transition pattern of (predicted signal, input image signal)=(64, 96), for example, is obtained by substituting these values into the above expression. That is, OS parameter=0+[(168−0)×96+(128−168)×64]/128=106.

In general, however, the response time of a liquid crystal panel varies so greatly with the gray-scale transition pattern that it cannot be expressed by a linear function. Therefore, a difference arises between the OS parameter obtained by calculation and the OS parameter obtained by measurement.

FIG. 10 shows an OS parameter table 18*b* obtained by calculating gray-scale levels corresponding to gray-scale transition patterns every 32 gray-scale levels using the OS parameter table 18*a* of FIG. 9. To state differently, the table 18*b* of FIG. 10 is a table in a 9×9 matrix expanded from the 3×3 matrix table 18*a*. FIG. 11 shows the OS parameter table 18 in a 9×9 matrix obtained by measurement under the same conditions.

By comparing the table 18*b* of FIG. 10 with the table 18 of FIG. 11, it is found that the corresponding gray-scale levels for the same gray-scale transition pattern are different from each other in some patterns. In consideration of this difference, in this embodiment, to determine an appropriate OS parameter for the next field, it is decided to predict the display state of the liquid crystal panel in the current field correctly, and for this, the number of gray-scale transition patterns set in the prediction table is made greater than the number of gray-scale transition patterns set in the OS parameter table.

In general, an OS parameter stored in the OS parameter table is determined so that a target gray-scale level is attained after one field. Using such an OS parameter, however, image noise may occur depending on the gray-scale transition pattern. In this case, a milder OS parameter may be set to avoid occurrence of image noise. In this embodiment, depending on the gray-scale transition pattern, the gray-scale level is set to be considerably milder than the level set for attainment of a target gray-scale level after one field. In other words, as the OS parameter in this embodiment, set is a target gray-scale level with which it is intended to complete the optical response of the liquid crystal panel 15 within one field or a mild gray-scale level milder than the target gray-scale level, for each gray-scale transition pattern of the combination of the gray-scale levels corresponding to two signals. As a result, the liquid crystal response is faster compared with the case of performing no overshoot drive, but attainment of a target gray-scale level after one field fails in some gray-scale transition patterns. A limit gray-scale level as described in Embodiment 2 is also set as the OS parameter in this embodiment.

Figures 12, 13:
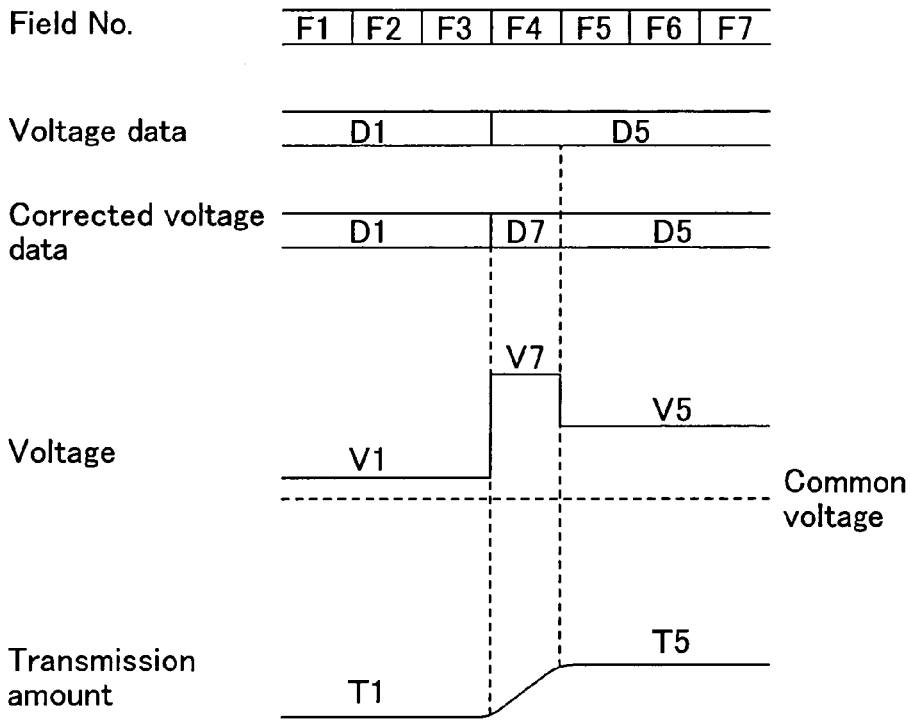
FIG. 12 is a view showing a prediction table in Embodiment 3 of the present invention.
FIG. 13 is a view demonstrating the drive method for a liquid crystal panel disclosed in Japanese Laid-Open Patent Publication No. 3-174186.

FIG. 12 shows an example of the prediction table 19 in this embodiment, which is in a 9×9 matrix. A gray-scale level actually obtained after the current field with an overshoot voltage is measured in advance for each gray-scale transition pattern and recorded in the prediction table 19.

The operation of the drive circuit in this embodiment will be described over two fields. For example, suppose the input image signal S for a given pixel changes in the order of S128, S0 and S128 with change of the field. Note that the reference numerals shown in FIG. 5 are used in the following description.

In the first field, when the input image signal in the current field is S0, the predicted value memory circuit 17 holds a signal S128 for the same pixel. The combination detector 12 detects the combination (S128, S0) of the predicted signal S128 held by the predicted value memory circuit 17 and the input image signal S0 in the current field. The combination detector 12 also detects an OS parameter S0 corresponding to this combination from the OS parameter table 18*b*, and outputs the result to the overshoot voltage detector 13. The overshoot voltage detector 13 detects a gray-scale voltage V0 corresponding to the OS parameter S0, and supplies the gray-scale voltage V0 to the polarity inverter 14 as the drive voltage.

The predicted value detector 16 detects a predicted signal S28 from the prediction table 19 based on the combination (S128, S0) detected by the combination detector 12, and the predicted value memory circuit 17 holds the predicted signal S28.

Subsequently, in the second field, in which the input image signal is S128, the combination detector 12 detects the combination (S28, S128) of the predicted signal S28 held by the predicted value memory circuit 17 and the input image signal S128 in the current field. The combination detector 12 also detects an OS parameter S159 corresponding to this combination from the OS parameter table 18*b* by calculation, and outputs the result to the overshoot voltage detector 13. The overshoot voltage detector 13 detects a gray-scale voltage V159 corresponding to the OS parameter S159, and supplies the gray-scale voltage V159 to the polarity inverter 14 as the drive voltage.

The predicted value detector 16 detects a predicted signal S123 from the prediction table 19 based on the combination (S28, S128) detected by the combination detector 12, and the predicted value memory circuit 17 holds the predicted signal S123.

As described above, in the drive circuit in this embodiment, when the input image signal for a given pixel changes in the order of S128, S0 and S128 with change of the field, the gray-scale voltages for the respective signals are V128, V0 and V159.

The relationship between the change of the input image signal and the change of the gray-scale voltage described in this embodiment is a mere example, and may vary with the characteristics and drive conditions of the liquid crystal panel, the precision of the OS parameters, the calculation method for interpolating the table and the like.

In this embodiment, the OS parameter table is a 3×3 matrix table, while the prediction table is a 9×9 matrix table. These are mere examples, and the numbers of gray-scale transition patterns in these tables are not limited to these. The number of gray-scale transition patterns in the prediction table may be just large enough to be able to compensate for an error arising due to the simplification of the OS parameter table. For example, the number of gray-scale transition patterns in the prediction table may be set so as to be larger than the number of gray-scale transition patterns set in the OS parameter table.

As the OS parameter table 18 is more simplified, the prediction table 19 is desirably set in more detail. Therefore, by simplifying the OS parameter table 18, the number of times of experiment for measuring OS parameters is reduced, but the number of times of experiment for measuring predicted values may be increased. However, since the experiment for measuring OS parameters takes more time and labor than the experiment for measuring predicted values, the advantage of reduction of the number of times of experiment for measuring OS parameters outweighs the disadvantage of some increase of the number of times of experiment for measuring predicted values if any. This will be described in more detail as follows.

To determine the OS parameter S168 corresponding to the combination (S0, S128) of the signal S0 held by the predicted value memory circuit 17 and the input image signal S128 in the current field, for example, it is necessary to first apply V0, then apply V168 in the next field (V0→V168), and confirm that the transmittance corresponding to S128 is attained within one field. Since it is previously unknown that the voltage in the next field is V168, it is necessary to repeat measurement with varying voltages such as (V0→V167) and (V0→V166) and examine the resultant transmittance for each measurement.

On the contrary, in the measurement of parameters of the prediction table for the same gray-scale transition patterns, one time of measurement (V0→V168) is enough because the OS parameter is already determined. In addition, data usable as predicted values are accumulated by repeating measurement with varying voltages for the measurement of OS parameters. Therefore, in the measurement of predicted values for gray-scale transition patterns other than the gray-scale transition patterns set in the OS parameter table 18, the measurement is not necessarily required for all of such gray-scale transition patterns. For example, in the case that the OS parameter table is a 3×3 matrix table and the prediction table 19 is a 9×9 matrix table, a total of 9×9−3×3=72 times of experiment are not necessarily required to measure predicted values. Therefore, reduction in the number of times of experiment for measuring predicted values is expected.

Comparative Example 3

The liquid crystal display apparatus of this comparative example has substantially the same configuration as that of Comparative Example 2 (see FIG. 15). The OS parameter table 118 used in this comparative example is the 3×3 matrix table of FIG. 9, in which the "predicted signal" and the "input image signal" in FIG. 9 should be read as the "input image signal in the preceding field" and the "input image signal in the current field", respectively.

As in Embodiment 3, suppose the input image signal S for a given pixel changes in the order of S128, S0 and S128 with change of the field. The OS parameter is S0 for the combination (S128, S0), and S168 for the combination (S0, S128) in the next field. Therefore, for the change of the input image signal for a given pixel in the order of S128, S0 and S128 with change of the field, the gray-scale voltages are V128, V0 and V168, respectively.

The image displayed on the liquid crystal display apparatus of Comparative Example 3 is brighter than original in the portion of this pixel, and this makes the viewer feel strange.

According to the present invention, a liquid crystal display apparatus capable of determining the overshoot voltage more appropriately is provided. The liquid crystal display apparatus of the present invention, in which insufficient or excessive liquid crystal response is reduced, blurring of an image due to an afterimage and generation of a bright spot at an edge of a moving image can be prevented, permitting high-quality moving image display.

While the present invention has been described in preferred embodiments, it will be apparent to those skilled in the art that the disclosed invention may be modified in numerous ways and may assume many embodiments other than that specifically set out and described above. Accordingly, it is intended by the appended claims to cover all modifications of the invention which fall within the true spirit and scope of the invention.

What is claimed is:

1. A liquid crystal display apparatus comprising:

a liquid crystal display panel for displaying an image by changing a gray-scale level to be displayed with change of a voltage level applied to a liquid crystal layer;

setting means for setting at least a target gray-scale level with which it is intended to complete the optical response of the liquid crystal display panel within one vertical period for each gray-scale transition pattern of a combination of gray-scale levels corresponding to two signals;

voltage application means for applying a target voltage level corresponding to the target gray-scale level set by the setting means to the liquid crystal layer;

a table at least including an actual gray-scale level actually obtained by the liquid crystal display panel after one vertical period when the voltage application means applies the target voltage level to the liquid crystal layer, the actual gray-scale level being set for each gray-scale transition pattern;

and correction means for correcting a target gray-scale level for an (n+1)th input image signal based on an actual gray-scale level obtained by referring to the table, for gray-scale transition from a gray-scale level of an (n−1)th input image signal to a gray-scale level of an n-th input image signal when the (n−1)th input image signal and the n-th input image signal are different in gray-scale level from each other.

2. The liquid crystal display apparatus of claim 1, wherein the setting means selectively sets the target gray-scale level and a limit gray-scale level that fails to reach the target gray-scale level and can be displayed by the liquid crystal display panel, the voltage application means selectively applies the target voltage level and a limit voltage level corresponding to the limit gray-scale level set by the setting means, and the table includes the actual gray-scale level obtained when the voltage application means selectively applies the target voltage level and the limit voltage level.

3. A liquid crystal display apparatus comprising:

a liquid crystal display panel for displaying an image by changing a gray-scale level to be displayed with change of a voltage level applied to a liquid crystal layer;

a first table including a target gray-scale level with which it is intended to complete the optical response of the liquid crystal display panel within one vertical period for each gray-scale transition pattern as a combination of gray-scale levels corresponding to two signals;

first setting means for setting the target gray-scale level by referring to the first table;

voltage application means for applying a target voltage level corresponding to the target gray-scale level set by the first setting means to the liquid crystal layer;

a second table including an actual gray-scale level actually obtained by the liquid crystal display panel after one vertical period when the voltage application means applies the target voltage level to the liquid crystal layer, the actual gray-scale level being set for each gray-scale transition pattern;

second setting means for setting the actual gray-scale level by referring to the second table; and correction means for correcting a target gray-scale level for an (n+1)th input image signal based on an actual gray-scale level set by the second setting means, for gray-scale transition from a gray-scale level of an (n−1)th input image signal to a gray-scale level of an n-th input image signal.

4. A liquid crystal display apparatus comprising:

a liquid crystal display panel for displaying an image by changing a gray-scale level to be displayed with change of a voltage level applied to a liquid crystal layer;

a first table including a target gray-scale level with which it is intended to complete the optical response of the liquid crystal display panel within one vertical period and a mild gray-scale level milder than the target gray-scale level, for each gray-scale transition pattern as a combination of gray-scale levels corresponding to two signals;

first setting means for setting the target gray-scale level or the mild gray-scale level by referring to the first table;

voltage application means for applying a target voltage level corresponding to the target gray-scale level set by the first setting means, or a mild voltage level corresponding to the mild gray-scale level set by the first setting means, to the liquid crystal layer;

a second table including an actual gray-scale level actually obtained by the liquid crystal display panel after one vertical period when the voltage application means applies the target voltage level or the mild voltage level to the liquid crystal layer, the actual gray-scale level being set for each gray-scale transition pattern;

second setting means for setting the actual gray-scale level by referring to the second table; and correction means for correcting a target gray-scale level for an (n+1)th input image signal based on the actual gray-scale level set by the second setting means, for gray-scale transition from a gray-scale level of an (n−1)th input image signal to a gray-scale level of an n-th input image signal.

5. The liquid crystal display apparatus of claim 3, wherein the number of gray-scale transition patterns set in the first table is smaller than the number of gray-scale transition patterns set in the second table.

6. The liquid crystal display apparatus of claim 4, wherein the number of gray-scale transition patterns set in the first table is smaller than the number of gray-scale transition patterns set in the second table.

* * * * *